US007600859B2

(12) United States Patent
Huang et al.

(10) Patent No.: US 7,600,859 B2
(45) Date of Patent: Oct. 13, 2009

(54) INKJET PRINTHEAD AND MANUFACTURING METHOD THEREOF

(75) Inventors: Chi-Ming Huang, Beidou Township, Changhua County (TW); Je-Ping Hu, Lujou (TW); Jian-Chiun Liou, Hsinchu (TW); Chia-Tai Chen, Hsinchu (TW); Fa-Yuan Hsu, Nantou (TW)

(73) Assignee: Industrial Technology Research Institute, Hsinchu (TW)

( * ) Notice: Subject to any disclaimer, the term of this patent is extended or adjusted under 35 U.S.C. 154(b) by 268 days.

(21) Appl. No.: 10/795,878

(22) Filed: Mar. 8, 2004

(65) Prior Publication Data

US 2005/0134646 A1 Jun. 23, 2005

(30) Foreign Application Priority Data

Dec. 17, 2003 (TW) ..... 92135703 A

(51) Int. Cl.
*B41J 2/05* (2006.01)

(52) U.S. Cl. ..... 347/63; 347/65

(58) Field of Classification Search ..... 347/64, 347/63, 58, 65

See application file for complete search history.

(56) References Cited

U.S. PATENT DOCUMENTS 4,596,994 A * 6/1986 Matsuda et al. ..... 347/64
4,609,427 A * 9/1986 Inamoto et al. ..... 216/27
5,699,462 A * 12/1997 Fouquet et al. ..... 385/18
6,210,522 B1 * 4/2001 Singh et al. ..... 347/50
6,412,918 B1 * 7/2002 Chen et al. ..... 347/56
6,702,428 B2 * 3/2004 Park et al. ..... 347/56
6,886,925 B2 * 5/2005 Chen et al. ..... 347/84
2001/0043243 A1 * 11/2001 Tachihara et al. ..... 347/15
2002/0054201 A1 * 5/2002 Takeda et al. ..... 347/221
2003/0227518 A1 * 12/2003 Murai et al. ..... 347/68
2004/0085435 A1 * 5/2004 Andrews et al. ..... 347/224
2004/0100535 A1 * 5/2004 Song et al. ..... 347/63

* cited by examiner

*Primary Examiner*—Julian D Huffman
*Assistant Examiner*—Jason S Uhlenhake
(74) *Attorney, Agent, or Firm*—Thomas, Kayden, Horstemeyer & Risley

(57) ABSTRACT

An inkjet printhead and a manufacturing method thereof. In the manufacturing method, a chip and a porous material are provided. A heating layer is formed on the chip. A conductive layer is formed on the heating layer, and includes a notch therein to define a heating area. A chamber for storing liquid is formed on the heating area, and includes a first side and a second side. The first side faces the heating area, and the second side is connected to the first side. The chamber is formed with an exit, from which the liquid is dispensed, on the second side. The porous material is disposed on the chamber, and the liquid flows to the chamber through the porous material.

1 Claim, 12 Drawing Sheets

INKJET PRINTHEAD AND MANUFACTURING METHOD THEREOF

BACKGROUND OF THE INVENTION

1. Field of the Invention

The invention relates to an inkjet printhead and its manufacturing method, and in particular, the invention relates to an inkjet printhead with high driving force.

2. Description of the Related Art

In a conventional inkjet printhead 10, an open-typed ink chamber is provided as shown in FIG. 1. Numeral 11 represents a feed channel, numeral 12 represents a heating device, numeral 13 represents an island for filtering the ink, and numeral 14 represents a cross section of an ink slot. The ink flows to the front side of the chip from the rear via the ink slot 14, and then fills the ink chamber via the feed channel 11. After a pulse voltage is applied to the heating device 12, the temperature of the heating device increases to generate bubbles. The ink is then dispensed via a nozzle plate, and re-supplied via the feed channel 11.

During the manufacture of the chip of the conventional inkjet printhead, the ink slot is necessary so that the ink can flow to the feed channel from an ink cartridge. The ink slot is formed by drilling through the chip. During drilling, the chip is continuously etched by fine, hard SiC powder for a long time, making it easily damaged. Also, the reliability of such drilling process is low, reducing the yield of the chip. Additionally, for a color inkjet printer with high resolution, three ink slots are formed on one chip. To reduce the area of the chip, the ink slot is a narrow and long rectangle, thus increasing the difficulty of the formation thereof.

Additionally, a nozzle plate is required on the conventional inkjet printhead. During assembly of the nozzle plate and the chip, precise alignment is required, thus increasing the assembly time. Also, assembly takes place individually, thus reducing the efficiency of the manufacture and increasing the cost.

Furthermore, since the ink chamber is open, in the conventional inkjet printhead, some liquid may flow back into the feed channel during dispensing. Thus, dispensing force may not be concentrated in the desired direction.

Moreover, the height of the ink chamber, the feed channel, and an adhesive layer between the chip and the nozzle plate are defined by organic polymer. Since the organic polymer is easily corroded by the ink, the ink may penetrate between the nozzle plate and the polymer, or between the chip and the polymer, thus reducing adhesive force and generating delamination.

FIG. 2 shows a conventional edge-shooting inkjet printhead 20. Numeral 21 represents a substrate, numeral 22 represents a heating area, numeral 23 represents a channel, numeral 24 represents a hole, numeral 25 represents a cover, and numeral 26 represents an orifice. During the formation of bubbles, driving force is not concentrated in the dispensing direction, reducing efficiency. Additionally, like the conventional inkjet printhead 10, the hole 24 is required in the cover 25, and the cover 25 must be precisely aligned with the substrate 21.

In U.S. Pat. No. 6,412,918, a back-shooting inkjet printhead is provided, requiring longer etching time, thus increasing cost and complicating process.

SUMMARY OF THE INVENTION

In view of this, the invention provides an inkjet printhead and manufacturing method with reduced cost and high driving force with no need for drilling and etching during manufacture.

Another purpose of the invention is to provide an inkjet printhead and manufacturing method without organic material, thus avoiding corrosion and allowing use of various ink type.

Still another purpose of the invention is to provide an inkjet printhead that can utilize liquid with higher coefficient of viscosity.

Accordingly, the invention provides a method for manufacturing an inkjet printhead. The method includes the following steps. A substrate and a porous material are provided. The porous material is a compound fabricated by sintering metallic powders at high temperature and pressure. During fabrication of the porous material, the gap between the metallic powders is smaller if the temperature is higher. That is, the gap between the metallic powders can be adjusted by the temperature. Thus, different kinds of porous material for filtering liquid can be provided. A heating layer and a conductive layer are then formed on the substrate. The conductive layer conducts a current to the heating layer. A heating area is defined by the conductive layer and the heating layer. A chamber for storing liquid is then formed above the heating area. The chamber includes a first side and a second side, with the first side facing the heating area. The second side is connected to the first side. The chamber is formed with an exit, from which liquid is dispensed, at the second side. The porous material is then placed on the chamber, thorough which liquid flows.

In a preferred embodiment, the method further includes the following steps. A conductive layout is formed on the conductive layer to conduct a pulse voltage signal to the heating area. Before the conductive layer is formed on the heating layer, a thermally-resistant layer is formed on the substrate. The thermally-resistant layer is formed between the substrate and the heating layer. After the conductive layer is formed on the heating layer, an isolation layer is formed on the conductive layer. The isolation layer is formed between the conductive layer and the chamber. After the isolation layer is formed on the conductive layer, a protective layer is formed on the isolation layer. The protective layer and the heating area overlap in a plumb direction. After the isolation layer is formed on the conductive layer, a notch is formed on the isolation layer. A connector is formed in the notch, connecting to the conductive layout.

And then the chamber is formed by light-sensitive polymer via exposure and developing. The light-sensitive polymer is a dry film or a liquid photoresist. The porous material is adhered to the light-sensitive polymer by hot press, and the light-sensitive polymer is used as an adhesive layer for the porous material.

In another preferred embodiment, the chamber is formed by electroplating metal. The metal may be Ni. After the chamber is formed, an adhesive layer is formed on the chamber. The adhesive layer comprise metal with a low melting point, such as PbSn (melting point 183° C.). The adhesive layer may be formed on the chamber by electroplating or screen printing. The adhesive layer is then covered by the porous material via hot press so that the porous material adheres to the adhesive layer.

It is understood that the porous material may be formed by sintering metallic powders or ceramic material, or may be polymer.

In another preferred embodiment, the method further includes the following step. A nozzle plate is provided, adhered to the second side of the chamber.

In the invention, an inkjet printhead is provided. The inkjet printhead comprises a substrate, a heating layer, a conductive layer, a chamber, and porous material. The heating layer is disposed on the substrate to dispense liquid. The conductive layer is disposed on the substrate to conduct a current to the heating layer. A heating area is defined by the conductive layer and the heating layer. The chamber is disposed on the heating area, and has a first side and a second side. The first side faces the heating area, and the second side is connected to the first side. The chamber is formed with an exit, from which the liquid is dispensed, on the second side. The porous material is disposed on the substrate, through which liquid flows.

In a preferred embodiment, the conductive layer is formed with a conductive layout to conduct a pulse voltage to the heating area.

In another preferred embodiment, the inkjet printhead further includes an isolation layer, a protective layer, a connector, and a thermally-resistant layer. The isolation layer is disposed between the conductive layer and the chamber. The protective layer is disposed between the isolation layer and the chamber. The connector is disposed on the isolation layer. The thermally-resistant layer is disposed between the substrate and the heating layer.

It is understood that the chamber may be formed by light-sensitive polymer or metal.

In another preferred embodiment, the inkjet printhead further includes an adhesive layer and a nozzle plate. The adhesive layer is disposed between the chamber and the porous material. The nozzle plate is disposed on the second side of the chamber.

In the invention, another method for manufacturing an inkjet printhead is provided. The method includes the following steps. A substrate, a porous material, and a nozzle plate are provided. A heating layer and a conductive layer are then formed on the substrate. The conductive layer conducts a current to the heating layer. A heating area is defined by the conductive layer and the heating layer. An adhesive layer is then formed on the conductive layer. The porous material is then placed on the chamber to form a chamber for storing liquid, through which liquid flows. The chamber includes a first side and a second side. The first side faces the heating area so that the liquid in the chamber is located above the heating area. The second side is connected to the first side. The nozzle plate is then adhered to the second side of the chamber, and comprises at least one orifice.

In a preferred embodiment, the adhesive layer comprises light-sensitive polymer, and includes a groove by cutting to form the chamber before placing on the adhesive layer.

In the invention, another inkjet printhead is provided, and comprises a substrate, a heating layer, a conductive layer, an adhesive layer, a porous material, and a nozzle plate. The heating layer is disposed on the substrate to dispense liquid. The conductive layer is disposed on the substrate to conduct a current to the heating layer. A heating area is defined by the conductive layer and the heating layer. The adhesive layer is disposed on the conductive layer. The porous material is disposed on the substrate, and includes a chamber. The liquid flows to the chamber through the porous material. The chamber has a first side and a second side. The first side faces the heating area such that the liquid in the chamber is located above the heating area. The second side is connected to the first side. The nozzle plate is disposed on the second side of the chamber, and includes at least one orifice.

BRIEF DESCRIPTION OF THE DRAWINGS

The present invention can be more fully understood by reading the subsequent detailed description and examples with references made to the accompanying drawings, wherein:

FIGS. 3A-5 are schematic views showing a method for manufacturing an inkjet printhead as disclosed in a first embodiment of the invention, wherein

DETAILED DESCRIPTION OF THE INVENTION

First Embodiment

FIGS. 3A-5 are schematic views showing a method for manufacturing an inkjet printhead 30 as disclosed in a first embodiment of the invention. In this embodiment, the inkjet printhead 30 is an edge-shooting type, provided with a porous material to generate high driving force. The manufacturing method thereof is described in the following.

Figure 3A:
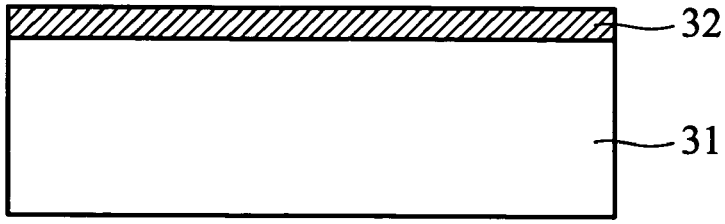
Figure 3B:
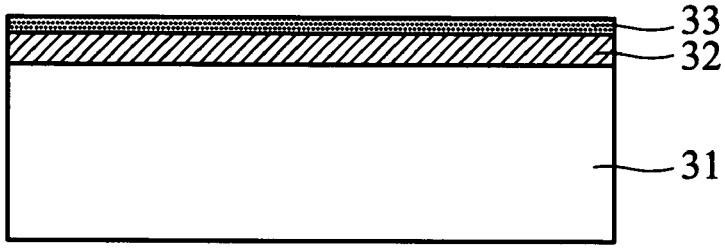
Figure 3C:
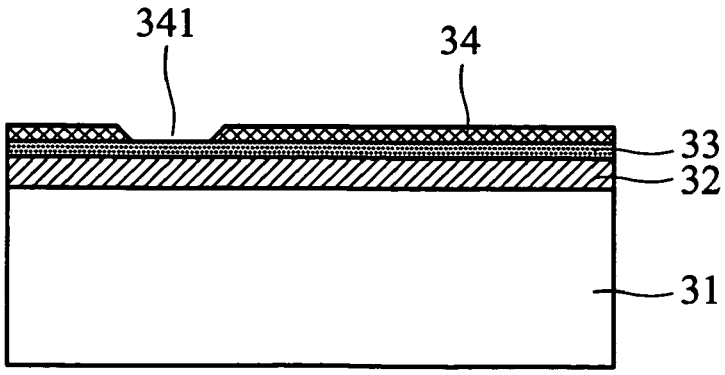
Figure 3D:
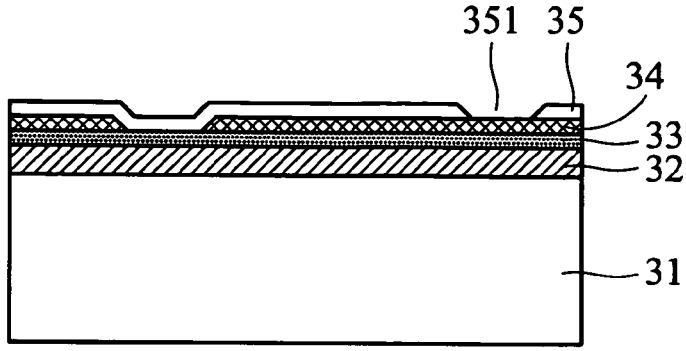
Figure 3E:
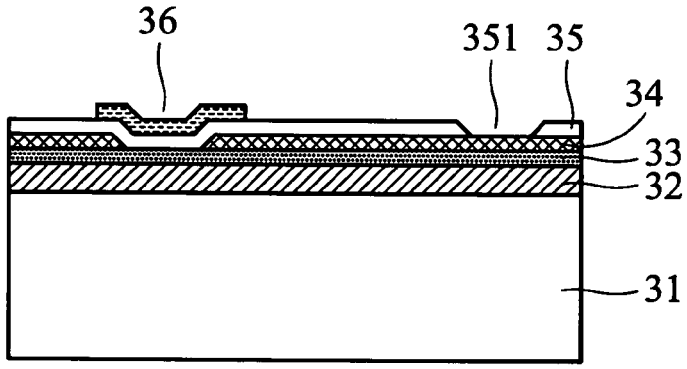
Figure 3F:
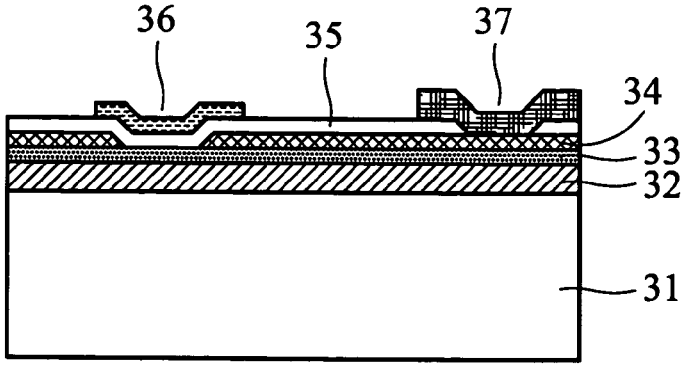
Figure 4C:
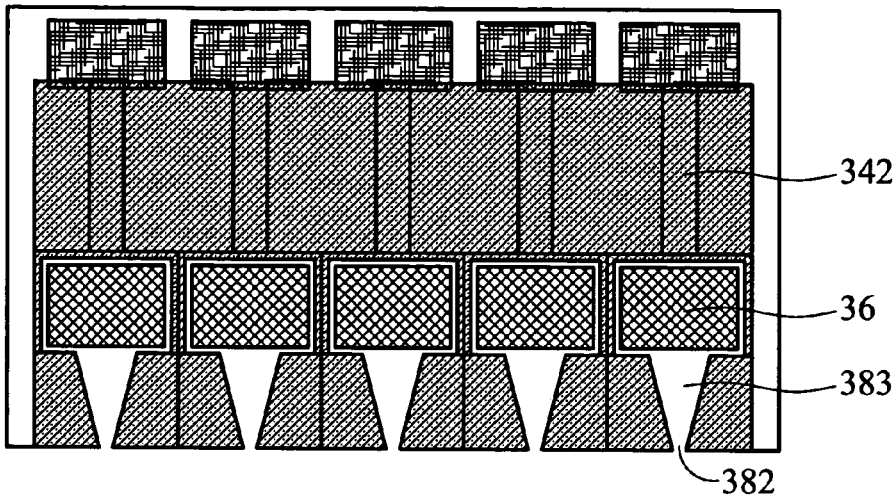
FIG. 4C is a top view of FIG. 4A.
Figure 5:
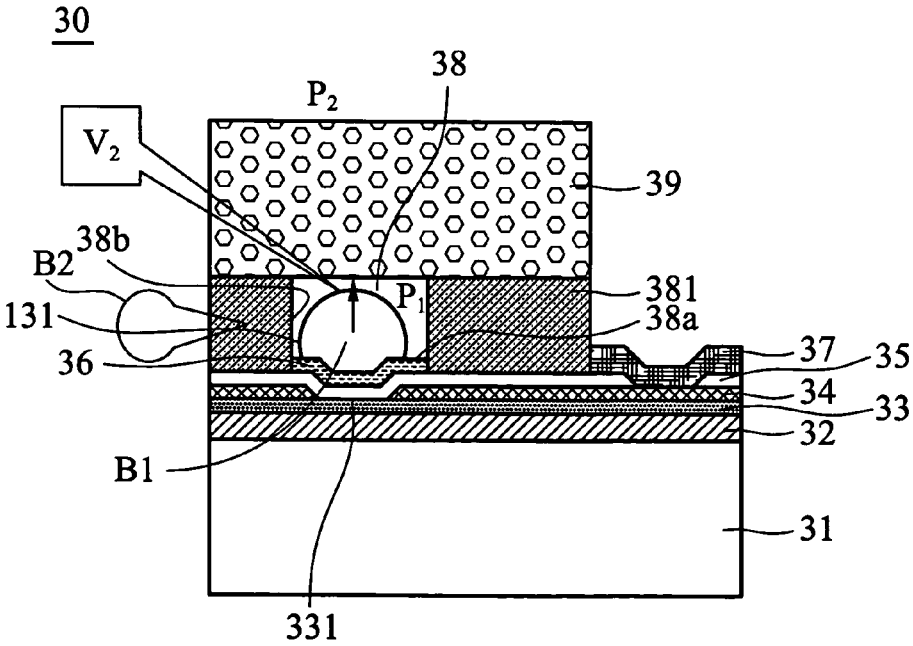

A chip 31 and a porous material 39, as shown in FIG. 5, are provided. The chip 31 is used as a substrate, and is formed with a thermally-resistant layer (thermal isolation layer) 32 as shown in FIG. 3A to prevent heat from dissipating toward the chip 31. A heating layer 33 is then formed on the thermally-resistant layer 32 as shown in FIG. 3B. A conductive layer 34 is then formed on the heating layer 33 as shown in FIG. 3C. A notch 341 and a conductive layout 342 (shown in FIG. 4C) are formed on the conductive layer 34 by photolithography and etching. Referring to FIG. 5, the notch 341 is used as a heating area 331; that is, the heating area 331 is defined by the conductive layer 34 and the heating layer 33. The conductive layer 342 conducts a pulse voltage signal to the heating area 331. An isolation layer 35 is then formed on the conductive layer 34, and shaped as shown in FIG. 3D to provide isolation. It is noted that a notch 351 is formed in the isolation layer 35. A protective layer 36 is then formed above the heating area 331, and shaped as shown in FIG. 3E to prevent reaction force generated by breakage of bubbles from damaging the heating area 331. A conductive connector 37 is formed in the notch 351 as shown in FIG. 3F, and shaped by photolithography and etching to electrically connect to the exterior. The basic structure of the inkjet printhead 30 is thus completed.

Figure 4A:
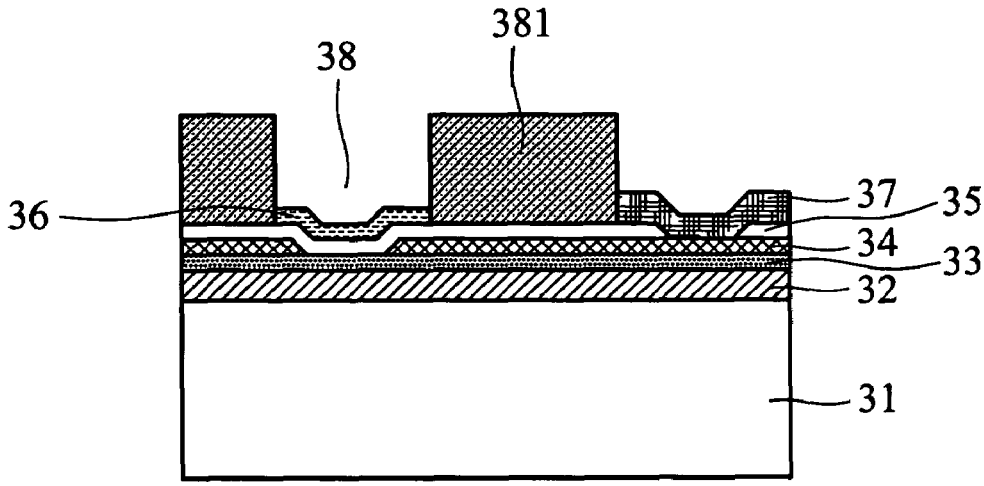
Figure 4B:
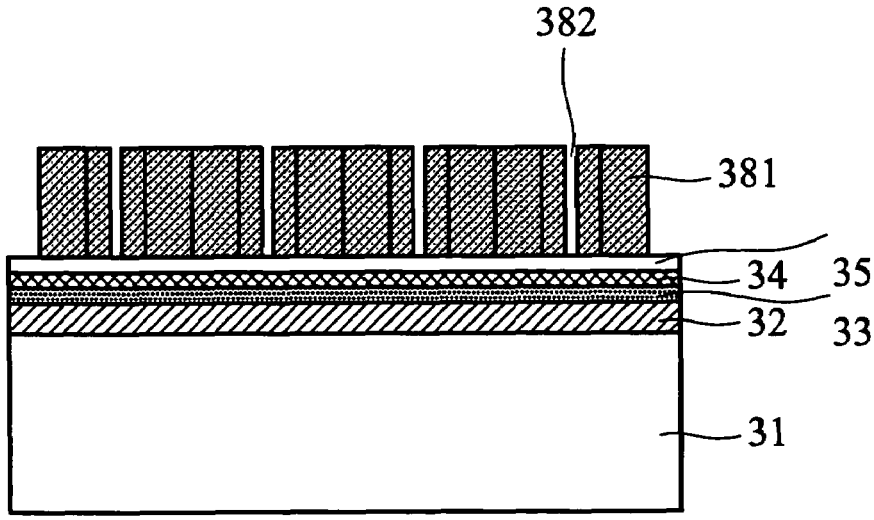
FIG. 4B is a right side view of FIG. 4A.

Referring to FIG. 4A, a chamber (ink chamber) 38 is formed on the chip 31, as shown in FIG. 3F, with layout thereon by light-sensitive polymer 381. The polymer 381 is formed with a plurality of nozzles (exits) 382 and a plurality of diverging sections 383 as shown in FIG. 4C. The polymer 381 is disposed on the chip 31 by hot press (dry film) or rotating coating (liquid photoresist). The thickness of the polymer 381 is about 20 μm, and the pattern thereof is defined by photolithography as shown in FIGS. 4A-4C, illustrating the exit 382. The porous material 39 is then adhered to the polymer 381 by hot press as shown in FIG. 5.

Specifically, the inkjet printhead 30 manufactured by the method disclosed in this embodiment is shown in FIG. 5, and comprises the substrate 31, the thermally-resistant layer 32, the heating layer 33, the conductive layer 34, the isolation layer 35, the protective layer 36, the connector 37, the chamber 38, and the porous material 39. The heating layer 33 comprises the heating area 331 to heat the liquid. The conductive layer 34 is formed with the notch 341 to expose the heating area 331. The chamber 38 has a first side 38*a* and a second side 38*b*, with the first side 38*a* facing the heating area 331. The second side 38*b* is connected to the first side 38*a*. The chamber 38 is formed with the exit 382, from which the liquid is dispensed, on the second side 38*b*. The porous material 39 is disposed on the chamber 38, through which liquid flows. It is noted that although the porous material 39 is disposed on the chamber 38 in the embodiment, the invention is not limited thereto. For example, the porous material can be disposed on the other position of the substrate as long as the liquid can flow to the chamber thereby.

It is understood that the inkjet printhead may further comprise a nozzle plate (not shown) and piezo-electric film (not shown). The nozzle plate can be disposed on the second side 38*b* of the chamber 38. The heating area can be replaced by the piezo-electric film.

In this embodiment, the inkjet printhead is provided with a closed-type ink chamber. As shown in FIG. 5, numeral B1 represents a generated bubble, and numeral B2 represents a dispensed droplet. The closed-type ink is chamber is sealed by organic polymer, and formed with a single exit in a dispensing direction. When the bubble is generated, driving force is entirely applied in the dispensing direction, enhancing the driving force. A comparison between the driving force in this embodiment and that in the conventional inkjet printhead is described in the following.

Figure 1:
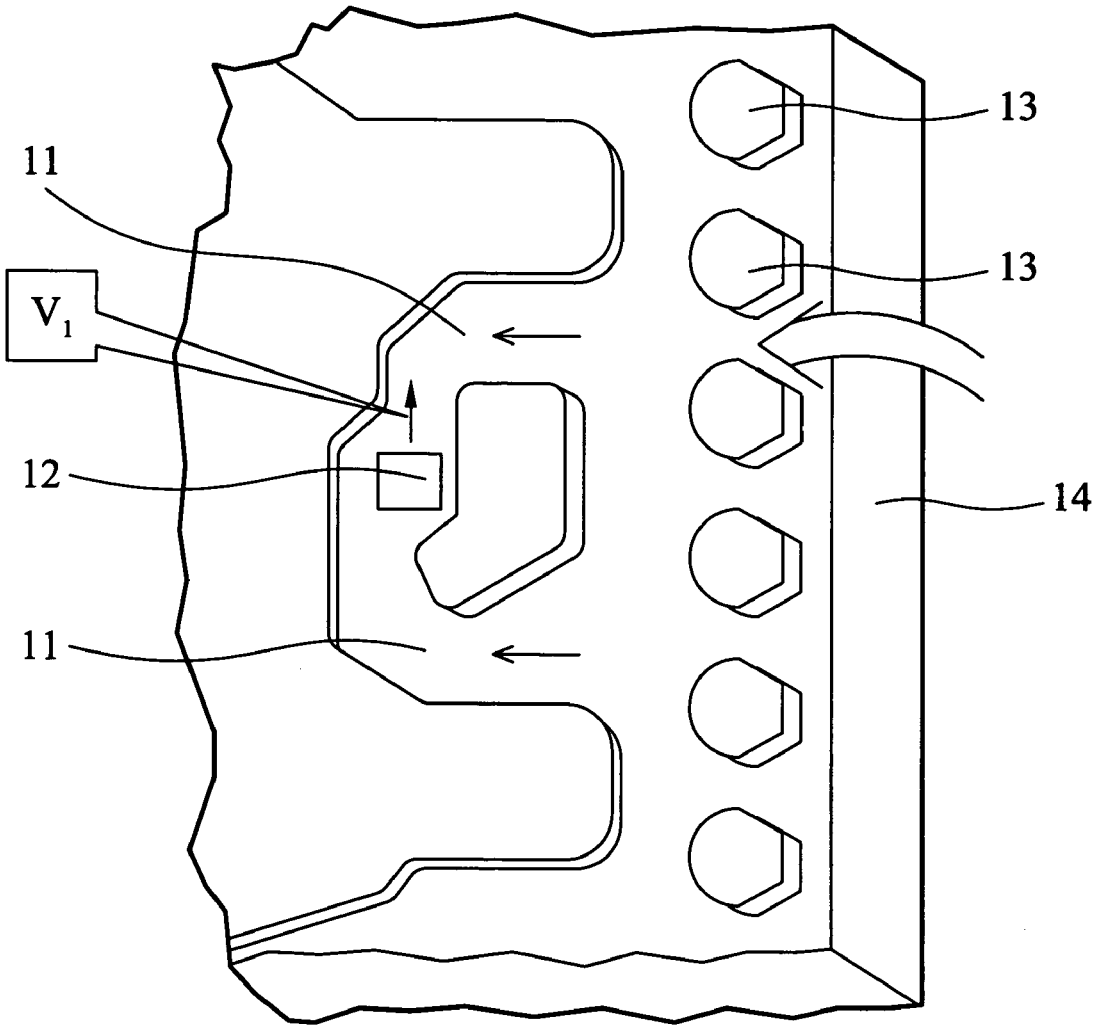
FIG. 1 ( RELATED ART )
FIG. 1 is a schematic view of a conventional inkjet printhead.
Figure 2:
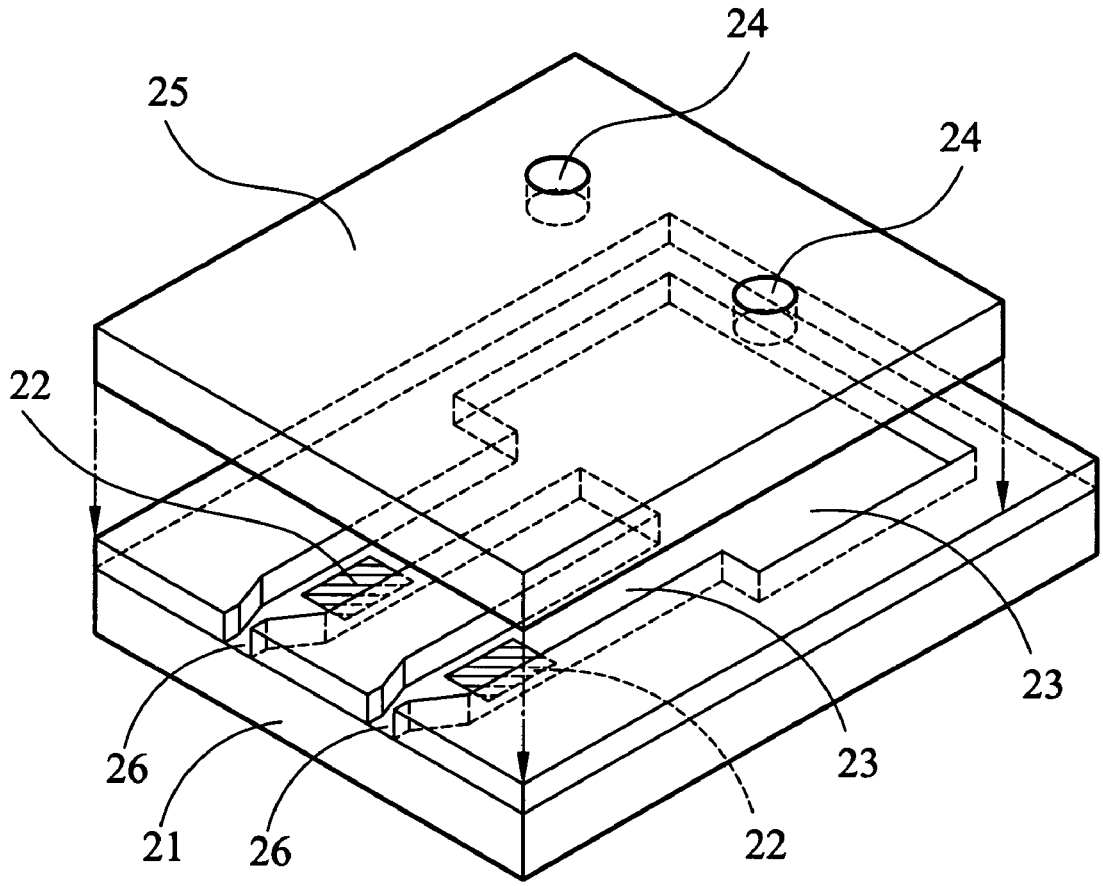
FIG. 2 ( RELATED ART )
FIG. 2 is a schematic view of a conventional edge-shooting inkjet printhead.

In the chip of the conventional inkjet printhead, an initial velocity $V_1$ of the liquid droplet from a chamber provided by the generation of the bubble can be defined by a channel formula, as shown in FIG. 1. The pressure differential between the exterior and interior of the chamber is proportional to the velocity of the fluid.

$$-\frac{\partial P}{\partial X} \propto V$$

wherein P is pressure, X is a direction of the channel, and V is velocity.

In contrast, with porous material covering the ink chamber in this embodiment, fluid in the chamber can only flow out in two directions, the dispensing direction and toward the porous material. Since resistance of the porous material exceeds the channel condition, the driving force by the bubble is largely applied in the dispensing direction. Specifically, initial velocity $V_2$ of the fluid toward the porous material due to the bubble can be defined by Darcy's law. The pressure differential between the exterior and interior of the chamber is proportional to the sum of first power and third power of the velocity of the fluid. The formula is:

$$-\frac{\partial P}{\partial X} = \frac{\mu}{K}V + \frac{\gamma\rho^2}{\mu}V^3$$

wherein P is pressure, X is a direction of the channel, V is velocity, μ is the coefficient of viscosity, and ρ is density of fluid.

Thus, the pressure differential in the porous material exceeds that in the channel condition; that is, $P_1$ exceeds $P_2$. As a result, pressure by the bubble in this embodiment exceeds that in FIG. 1. Most pressure remains in the chamber to propel the droplet toward the exit 382. That is, flow of the liquid is limited toward the porous material 39, thus enhancing driving force.

Furthermore, the supply of ink via the porous material is described in the following.

According to the test data of the porous material, the flow rate of deionized water through the inslot of the chip from the porous material is tested under various positive pressures as follows. The porous material is combined with the chip that is sandblasted and provided with defined dry film. The porous material is then assembled with a liquid reservoir (cartridge) by adhesive. The liquid reservoir is then connected with a steel bottle under adjustable pressure. By means of a computer, the steel bottle provides regulated pressure to the cartridge. Test results are shown in the following table.

| | Pressure 0.5 kg/cm$^2$ | Pressure 0.2 kg/cm$^2$ |
|---|---|---|
| Radius 10 μm | Flow rate 24.66 cc/min | Flow rate 8.36 cc/min |
| Radius 5 μm | Flow rate 11.06 cc/min | |
| Radius 2 μm | Flow rate 6.38 cc/min | Flow rate 1.38 cc/min |
| Radius 0.5 μm | Flow rate 2.25 cc/min | |

Thus, flow rate increases with pressure. Under the same pressure, flow rate increases with the radius. Accordingly, ink can be effectively supplied to the chamber via the porous material.

As stated above, the inkjet printhead of the embodiment is provided with a closed-type chamber, and dispensed by edge-shooting. Also, the liquid can enter into the chamber via the porous material due to pressure from the ink reservoir. After the bubble is generated in the chamber, the liquid can be dispensed in a direction perpendicular to the direction in which the bubble is generated. Thus, there is no requirement for sand-blasting, the alignment of the nozzle plate, or etching of the chip during manufacture. Thus, costs are reduced.

Furthermore, in the embodiment, since the porous material and the chip are assembled wafer to wafer, the manufacturing method is simpler and more efficient. Before cutting the combination of chip and porous material, the rear of the chip can be marked for mass-production. However, the sequence of the assembly and the cutting is not limited thereto. For example, the porous material and the chip can be cut prior to assembly.

Additionally, in this embodiment, the closed-type chamber is formed by the porous material and light-sensitive polymer, the height thereof defined by the light-sensitive material. Since the exits are only formed in the dispensing direction of the light-sensitive polymer, the driving force of the bubble is entirely applied in the dispensing direction.

Second Embodiment

Figure 6A:
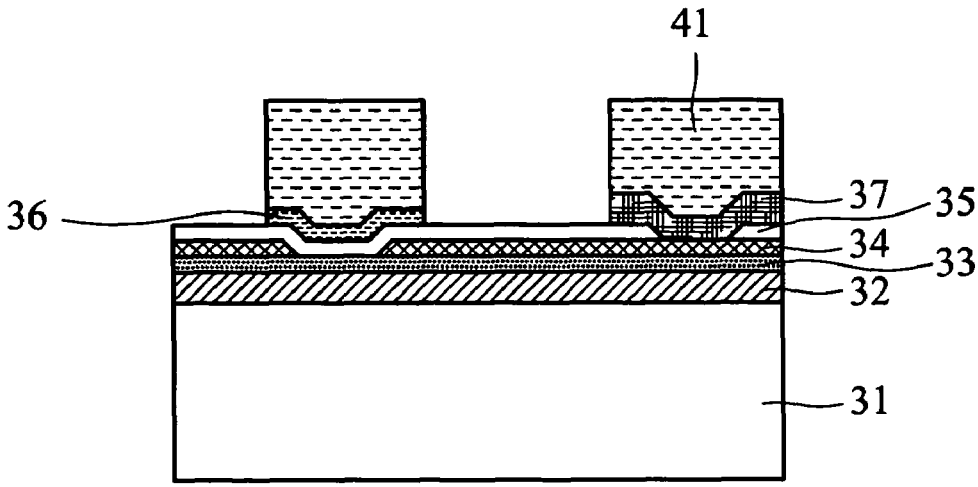
FIGS. 6A-6F are schematic views showing a method for manufacturing an inkjet printhead as disclosed in a second embodiment of the invention.
Figure 6B:
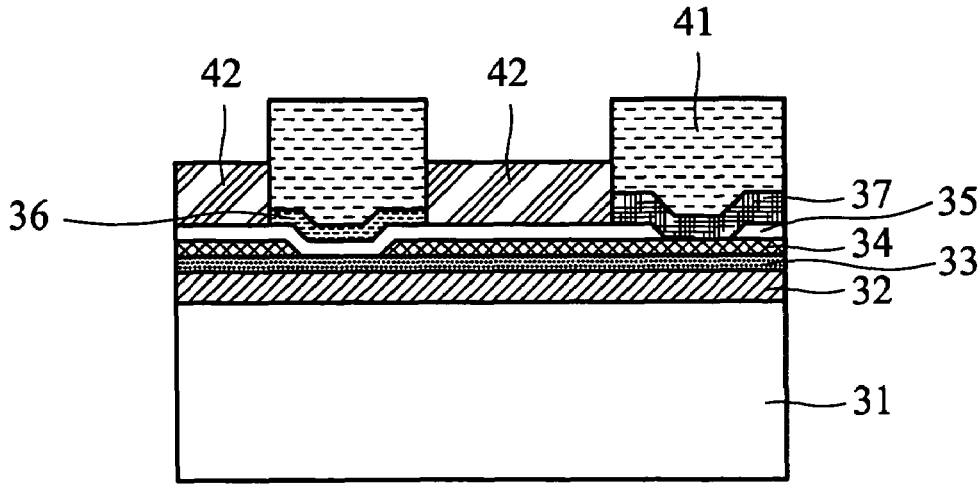
Figure 6C:
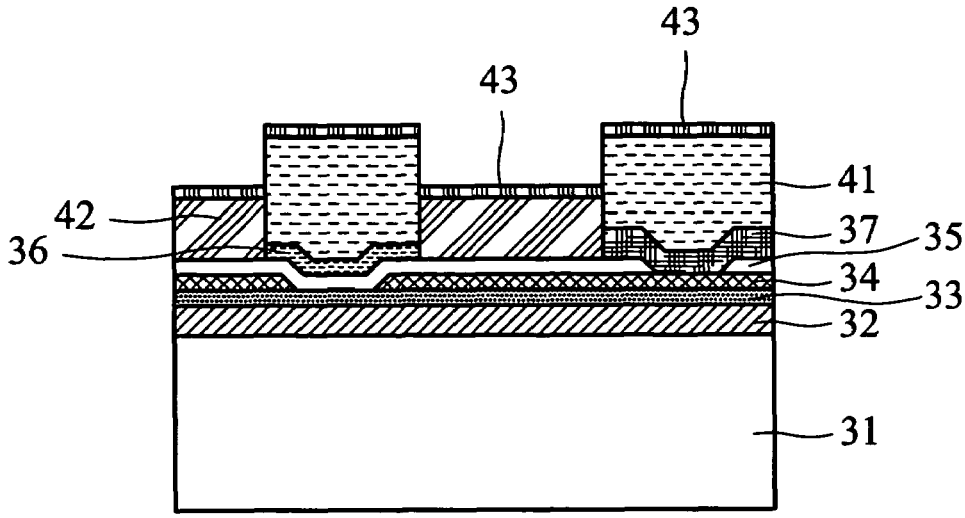
Figure 6D:
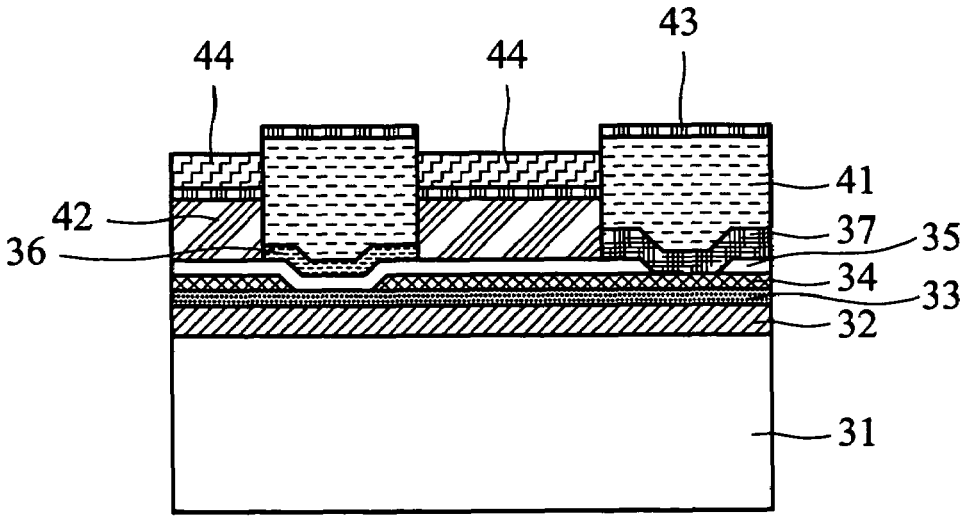
Figure 6E:
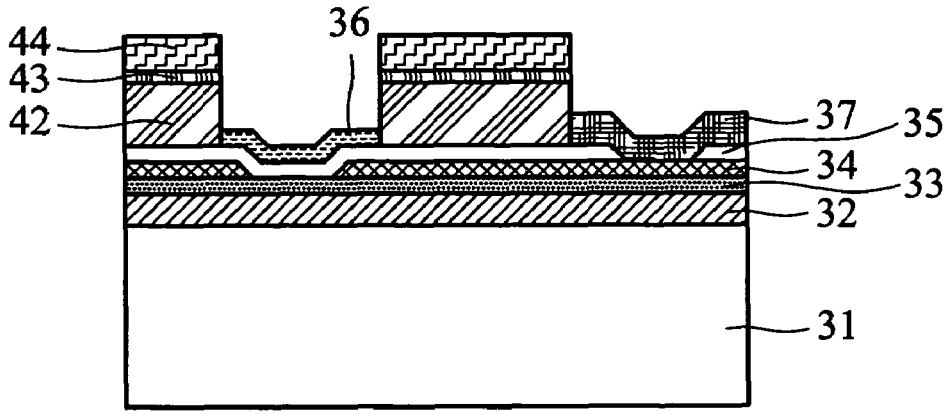
Figure 6F:
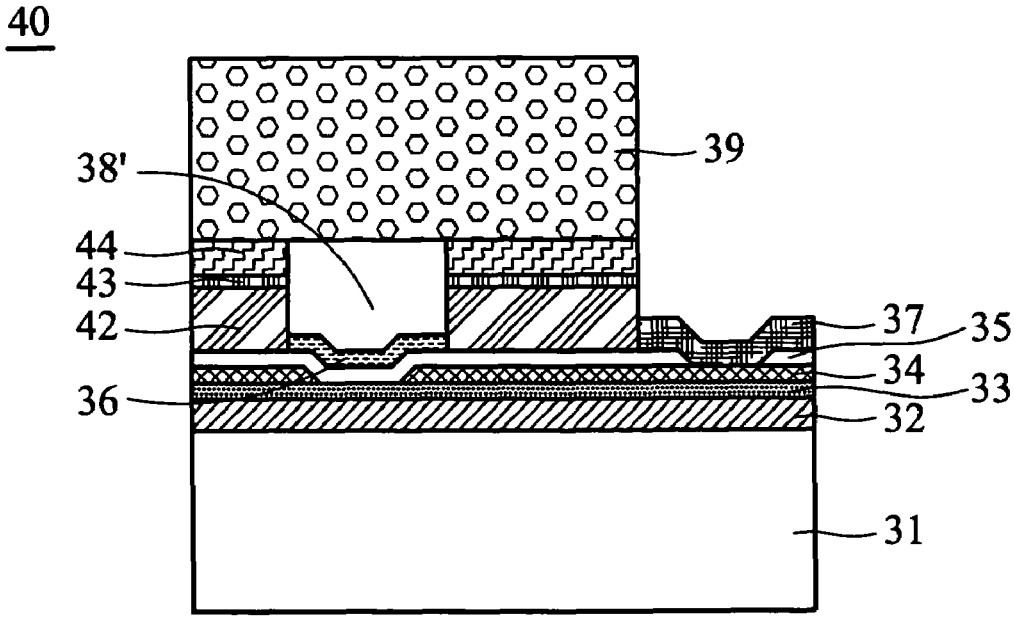

FIGS. 6A-6F are schematic views showing a method for manufacturing an inkjet printhead 40 as disclosed in a second embodiment of the invention. This embodiment differs from the first embodiment in that an ink chamber 38', provided with divergent sections and shown in FIG. 6F, is defined by metal. The metal is then combined with the porous material 39, thus forming a no organic structure. Since the metal avoids corrosion from the ink, the lifetime of the chip is increased. Specifically, in conventional inkjet printhead, the height of the chamber is defined by organic polymer. The organic polymer is easily corroded by the ink, which may penetrate between the nozzle plate and the polymer, or between the chip and the polymer, causing the delamination of the polymer. By contrast, in this embodiment, since the chamber is formed by metal, it better resists corrosion. As a result, the structure of this embodiment can utilize various kinds of ink or organic chemical, and can be applied in various areas, such as printers, bio-chips, medicine transport, color filtering, fuel nozzle, or other industry types.

The method includes the following steps. Photoresist 41 is uniformly coated on the chip 31, shown in FIG. 3F and provided with layout, by rotation. After development, the thickness of the photoresist 41 is about 40 μm as shown in FIG. 6A, and is used as a sacrifice layer during electroplating. As shown in FIG. 6B, a Ni-layer 42 is formed on an area without photoresist 41 covering, with thickness of about 10 μm. Another metallic layer 43, such as Au, is then formed on the chip 31 by evaporation, with thickness of about 1000 Å as shown in FIG. 6C. The metallic layer 43 acts as an adhesion layer between the Ni-layer 42 and a metallic layer 44 with low melting point. The metallic layer 44 is then formed thereon by electroplating as shown in FIG. 6D, with thickness of about 10 μm. The metallic layer 44 may be PbSn, with melting point of 183° C. The chip 31 is then placed in a solution removing the photoresist 41 but not damage the metallic layers or thin film on the chip, as shown in FIG. 6E. The porous material 39 is then disposed on the chip after electroplating. By heating and pressurizing the porous material 39, the surface, contacting the porous material 39, of the metallic layer 44 is melted due to its low melting point. After cooling, the porous material 39 is combined to form a no organic structure as shown in FIG. 6F.

Figure 7:
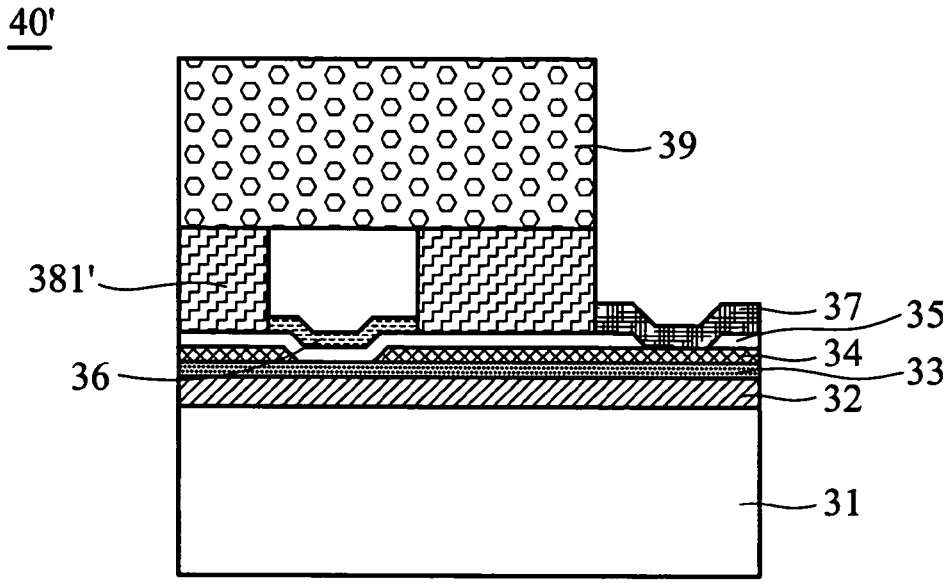
FIG. 7 is a schematic view showing a variant embodiment of an inkjet printhead in FIG. 6F.

Additionally, the entire chamber may be defined by metal with low melting point. For example, in an inkjet printhead of FIG. 7, numeral 381' represents the metallic layer with low melting point. The metallic layer 381' may be formed by electroplating or screen printing.

As stated, an inkjet printhead requiring no organic elements is provided in this embodiment. The porous material is combined with the chip via the metallic layer with low melting point, and the printhead can utilize various ink types.

Third Embodiment

FIGS. 8A-8E are schematic views showing a method for manufacturing an inkjet printhead 50 as disclosed in a third embodiment of the invention. This embodiment differs from the first embodiment in that the porous material is additionally processed before combining with the chip. Specifically, the porous material is cut to define the chamber, and then combined with the chip. A nozzle plate is disposed on one side of the porous material to complete the inkjet printhead of this embodiment.

Figure 8A:
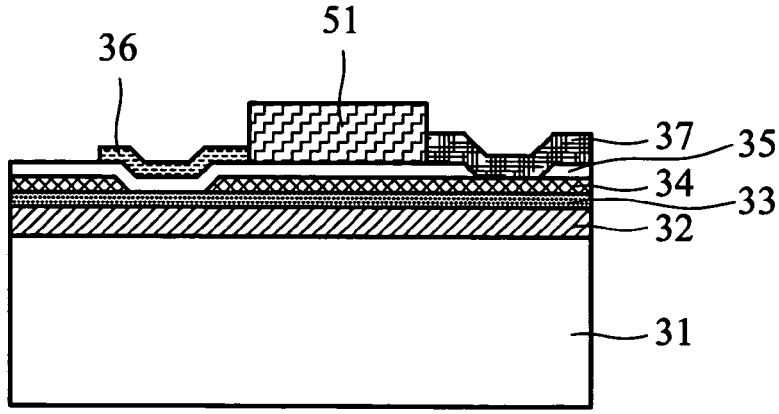
FIGS. 8A-8E are schematic views showing a method for manufacturing an inkjet printhead as disclosed in a third embodiment of the invention.
Figure 8B:
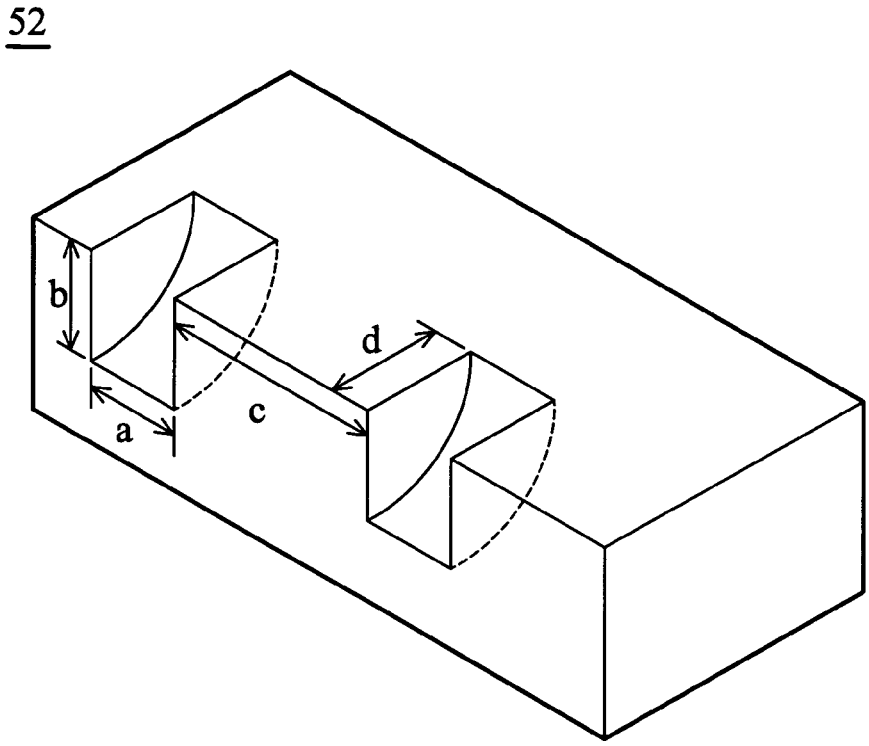
Figure 8C:
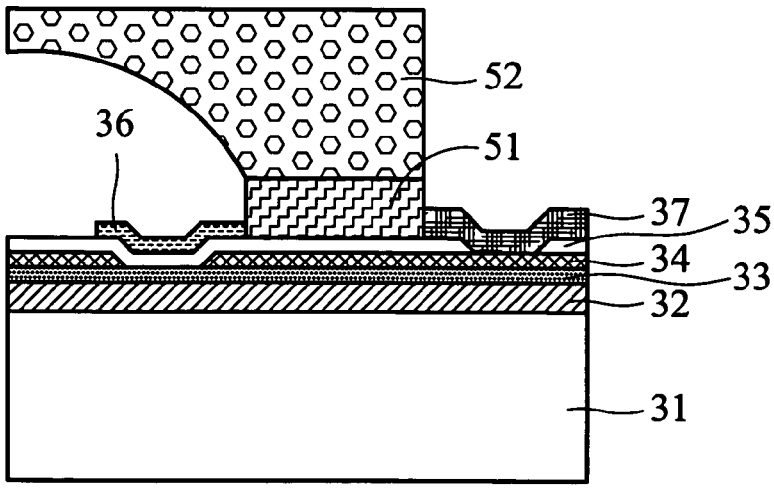
Figure 8D:
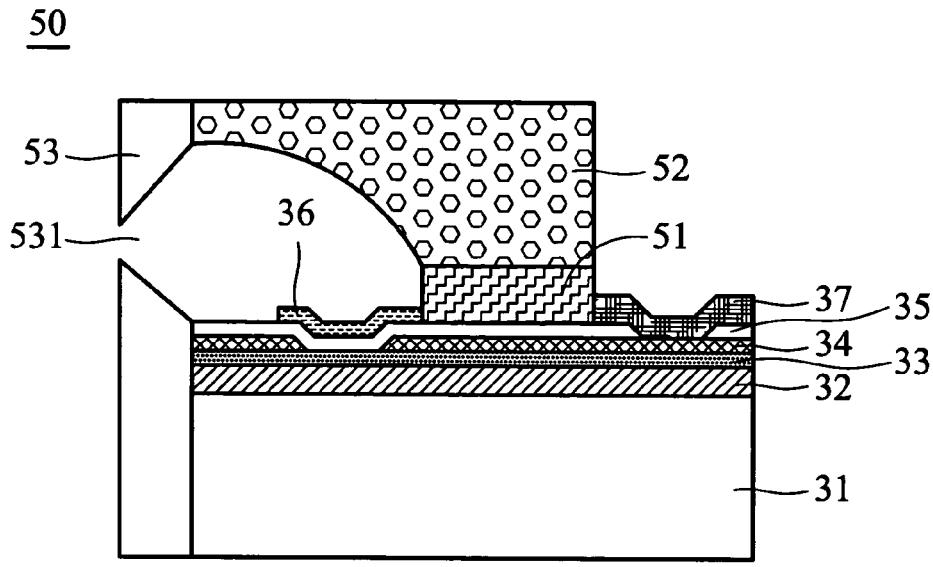
Figure 8E:
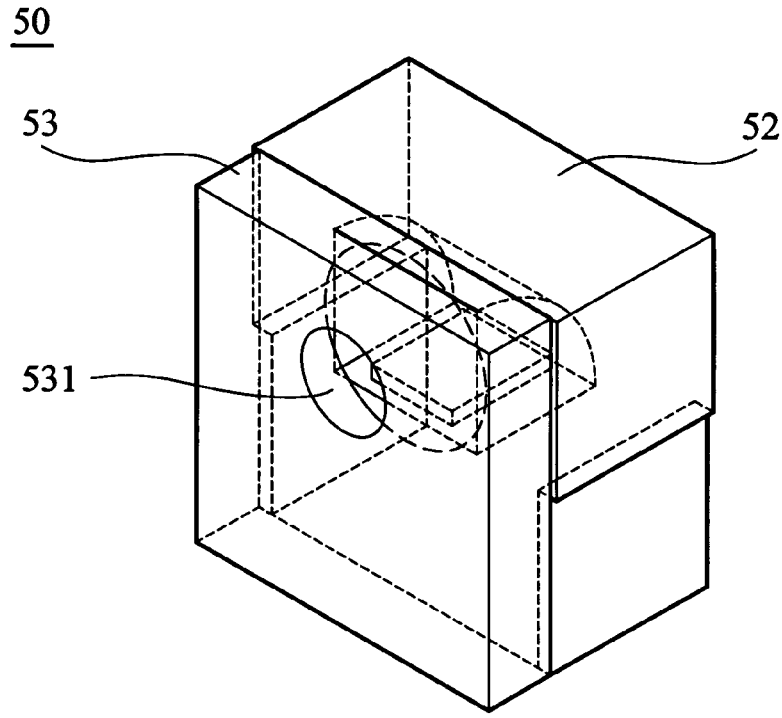

The method includes the following steps. A metallic layer 51 with low melting point is formed on the chip 31 with layout, at thickness of about 10 μm as shown in FIG. 8A. Additionally, a porous material 52 is processed as shown in FIG. 8B. Specifically, the porous material 52 is cut by a series of cutters at 30 μm thickness to define the size of the chamber; with section a 60 μm, section b 60 μm, section c 80 μm, and section d 70 μm. The porous material 52 is then combined with the chip by hot press as shown in FIG. 8C. A nozzle plate 53 is then adhered to the side of the chip as shown in FIGS. 8D-8E. The nozzle plate 53 is metallic plate with adhesive thereon, and is processed by laser to form orifices 531.

As stated above, the inkjet printhead provides higher driving force to dispense liquid with high coefficient of viscosity. Additionally, no organic structures in the inkjet printhead allow use of various ink types.

While the invention has been described by way of example and in terms of the preferred embodiment, it is to be understood that the invention is not limited to the disclosed embodiment. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An inkjet printhead comprising:

a substrate;

a heating layer disposed on the substrate to dispense liquid;

a conductive layer disposed to conduct a current to the heating layer, wherein the conductive layer comprises a stepped portion used as a heating area, wherein the heating area is defined by the conductive layer and the heating layer;

an adhesive layer disposed on the conductive layer;

a porous material, disposed on the substrate, including a chamber, wherein the liquid flows to the chamber through the porous material, the chamber has a first side and a second side, the first side is overlapped with the heating area so that the liquid in the chamber is located above the heating area, and the second side is connected to the first side; and a nozzle plate, disposed on the second side of the chamber, including at least one orifice, wherein the nozzle plate abuts the porous material.

* * * * *